United States Patent [19]

Jones

[11] 3,996,864

[45] Dec. 14, 1976

[54] FURNACE DAMPER AND SUPPORT

[75] Inventor: Allen Jacob Jones, Grants Pass, Oreg.

[73] Assignee: S. J. Agnew, Tenino, Wash.

[22] Filed: Dec. 15, 1975

[21] Appl. No.: 640,896

[52] U.S. Cl. ..... 110/163; 126/285 A

[51] Int. Cl.[2] ..... F23L 13/06

[58] Field of Search ..... 126/285 R, 285 N; 110/163

[56] References Cited

UNITED STATES PATENTS

| | | | |
|---|---|---|---|
| 969,188 | 9/1910 | Pruitt | 110/163 X |
| 1,634,559 | 7/1927 | Schmidt | 110/163 |
| 1,684,200 | 9/1928 | Pollack | 110/163 X |
| 3,598,067 | 8/1971 | Jones | 110/163 |
| 3,716,004 | 2/1973 | Jones | 110/163 |

*Primary Examiner*—Kenneth W. Sprague
*Attorney, Agent, or Firm*—Kolisch, Hartwell, Dickinson & Stuart

[57] ABSTRACT

A damper for controlling the passage of combustion gases through a conduit in a furnace. The damper is a mass of formed refractory material shiftable through an opening in the side of the conduit between an operative position extending into the conduit and inoperative position spaced laterally of the conduit. The damper is mounted on an elongate hollow beam which has a coolant fluid flow passage extending therethrough and apertures through which coolant fluid may pass to cool the exterior of the damper and support. A housing extends laterally of the conduit and has side and end walls positioned to receive and enclose portions of the damper and damper support retracted from the conduit. The damper support is enclosed and shielded by the housing walls throughout operation of the apparatus. A coolant fluid supply is operable to inject coolant fluid under pressure into the damper support so that such fluid may flow outwardly therefrom to cool the damper support and surfaces of the damper.

12 Claims, 5 Drawing Figures

FURNACE DAMPER AND SUPPORT

BACKGROUND AND SUMMARY OF THE INVENTION

This invention relates to apparatus for controlling the flow of combustion gases through a furnace conduit, and more particularly to a damper shiftable into and out of the conduit and having a damper support through which a coolant fluid may flow to cool the support and damper.

As combustion gases are produced and flow through various conduits in a furnace, it is often necessary either to close or open the damper to selected degrees to provide a control of the flow of such gases through the conduit. Various styles of dampers have been designed in the past, with some of previous dampers attempting to provide circulation of coolant fluid about the damper or through coils in the damper in an attempt to cool the same. These have not been altogether satisfactory in that in such previous devices the coils or conduits for passage of coolant fluid have been metallic and have been positioned in the damper in such a manner that they are subjected to the direct effects of the combustion gases. Further, such previous devices usually have provided merely for the recirculation of a coolant fluid and have not provided for any flow of coolant fluid over the faces of the damper to aid in cooling the same.

In such previous dampers there has been little, if anything, to shield metallic supports for the damper from the direct effects of combustion gases and thus they have been weakened and detrimentally affected by the combustion gases.

A general object of the present invention is to provide novel apparatus for controlling the flow of combustion gases through a furnace conduit including a damper and damper support from which a flow of coolant fluid may pass to cool the damper and support, which apparatus is so constructed as to overcome the disadvantages of prior devices as set out above.

More specifically, an object of the invention is to provide a damper constructed of refractory material mounted for shifting into and out of the conduit and having a metallic damper support connected to and supporting the edge of the damper opposite that edge which is shifted into and out of the conduit, with the damper support having a coolant fluid flow passage therein and apertures extending between the passage and exterior of the support through which a flow of coolant fluid may flow to the exterior of the support to cool the damper and support.

A further object is to provide such novel apparatus in which the damper has coolant fluid passages defined therein and extending therethrough communicating with the passage in the support to permit a flow of coolant fluid to pass through the damper.

A still further object is to provide such novel apparatus which includes a housing extending laterally of the conduit which has side and end walls so positioned as to receive and enclose the damper support throughout operation of the damper, thus to shield the damper support from direct effects of the combustion gas throughout operation of the damper.

Yet another object of the invention is to provide such apparatus which includes novel means for supplying a flow of coolant fluid under pressure to the damper support and damper housing.

These and other objects and advantages will become more fully apparent as the following description is read in conjunction with the drawings.

DRAWINGS

DETAIL DESCRIPTION OF AN EMBODIMENT OF THE INVENTION

Figures 1, 2, 3:
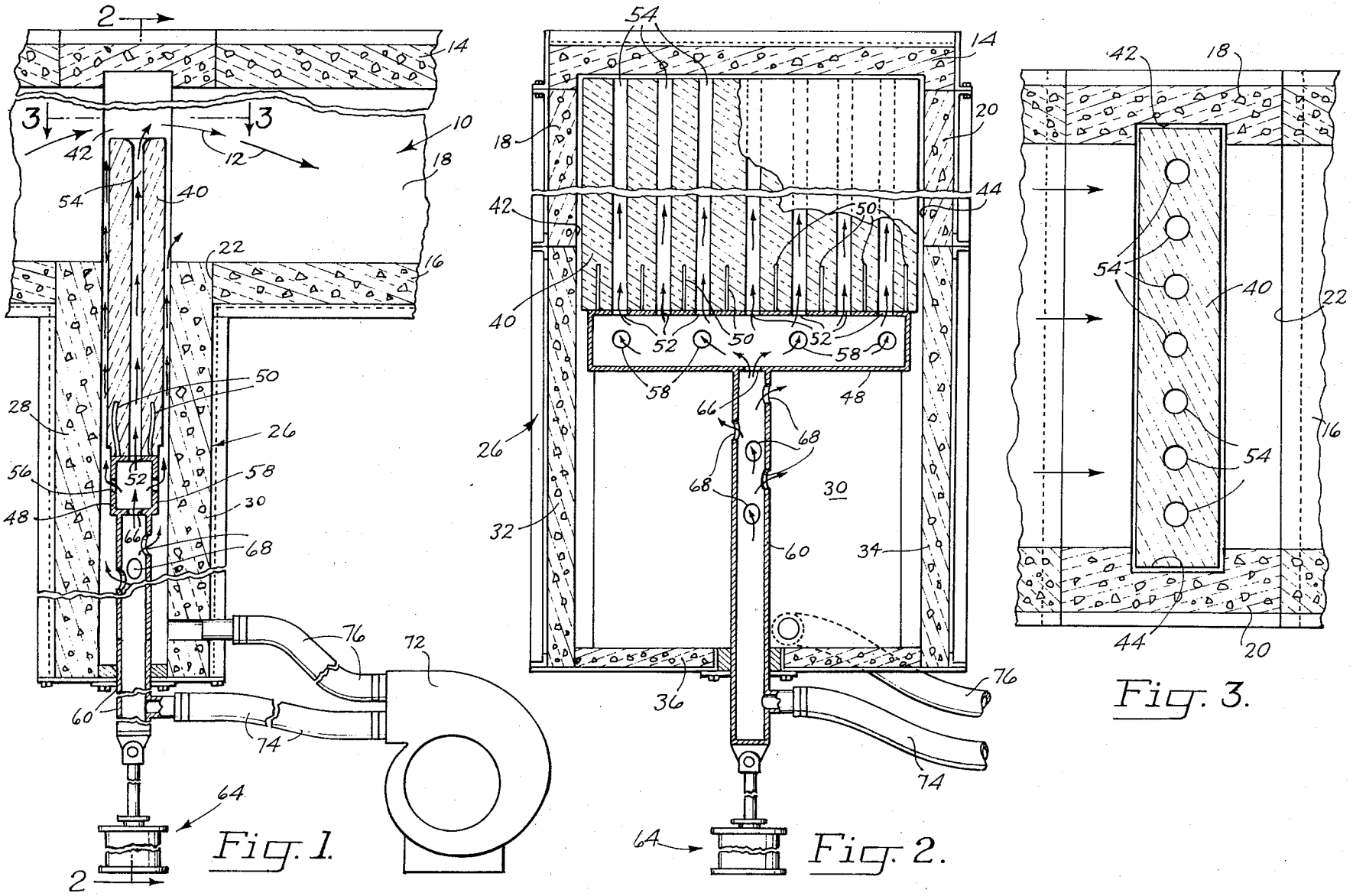
FIG. 1 is a cross-sectional side elevation view of apparatus constructed according to an embodiment of the invention with the damper therein partially opened.
FIG. 2 is a view taken generally along the line 2—2 in FIG. 1 with the damper closed.
FIG. 3 is a somewhat enlarged view taken generally along the line 3—3 in FIG. 1.

Referring to the drawings, and first more specifically to FIG. 1, at 10 is indicated generally a conduit through which combustion gases may flow in a furnace. The flow of the combustion gases is indicated by arrows 12. The conduit is defined by upper and lower walls 14, 16, respectively, and opposed side walls 18, 20, as seen in FIG. 2.

An opening 22 is formed in lower wall 16. Walls 14, 16, 18 and 20 are formed of a refractory material.

An elongate damper housing indicated generally at 26 is secured to lower wall 16, and extends at its upper end into opening 22. Remainder portions of housing 26 depend from lower wall 16, and thus extend laterally of conduit 10. The housing includes upright opposed refractory side walls 28, 30 and refractory end walls 32, 34. The lower end of the housing is closed by a bottom wall 36. As is best seen in FIG. 1, the upper end of housing 26 opens into conduit 10.

Mounted for vertical shifting within housing 26 is a cast refractory damper 40. The damper is a mass of formed refractory material having a generally rectangular configuration. Guide slots 42, 44 (see FIG. 3) are provided in side walls 18, 20 of the conduit and end walls 32, 34 of the housing to guide the damper throughout vertical shifting between a closed, or extended, position as illustrated in FIG. 2 raised to a position with the upper, or leading, edge closely adjacent upper wall 14 of the conduit to substantially close off the conduit, and a lowered, or retracted, position lowered completely into housing 26 to produce no damping or flow control effect in conduit 10.

An elongate, hollow metal box beam 48, also referred to as a damper support, underlies and supports a major portion of the underside of damper 40. Anchor rods 50 secured, as by welding, to the upper side of beam 48 extend into the refractory material of damper 40 and secure the damper to the beam. A plurality of apertures 52 are formed in the top of beam 48 and communicate with elongate bores, or apertures, 54 extending vertically through damper 40. A plurality of apertures 56, 58 extend through opposite sides of beam 48.

An elongate, hollow, tubular metal rod 60 is secured, as by welding, to the bottom of box beam 48 and extends downwardly therefrom slidably through an opening in bottom wall 36 in the housing. The lower end of rod 60 is operatively connected to the rod end of a reciprocal fluid-actuated ram 64. Extension of ram 64 serves to lift rod 60, beam 48, and damper 40 toward its raised position, and retraction of the ram serves to lower the damper into the housing. As is seen in FIGS. 1 and 2, an aperture 66 provides communication between rod 60 and the interior coolant fluid passage within beam 48. Other apertures 68 in the side walls of rod 60 provide communication between the interior of rod 60 and housing 26.

A blower, or fan, 72 is operatively connected through a flexible conduit 74 to the lower end of rod 70 and through a flexible conduit 76 to the interior of housing 26.

Describing the operation of this apparatus, as heated combustion gases are conducted along a path through conduit 10 damper 40 may be shifted vertically by extension or retraction of ram 64 selectively to control the flow of the combustion gases. The construction of the damper and housing are such that the lower end of damper 40 and box beam 48 are always within the enclosure provided by housing 26. They thus are shielded from the direct effects of the hot combustion gas which otherwise might produce a detrimental effect to the metal construction of the box beam.

Blower 72 is operable to inject a flow of coolant air into rod 60 and the interior of housing 26. Such coolant fluid is injected under pressure whereby it flows upwardly through rod 60 into the passage provided by the hollow interior of box beam 48 and also into bores 54 in the damper. Such coolant fluid also is able to exhaust from the rod through apertures 68, from the box beam through apertures 52, 56, 58, and also to pass through bores 54 in the damper. The side and end walls of the housing direct a flow of coolant air up along opposite faces of damper 40 to provide a boundary layer of cooler air flowing along the face surfaces to cool such surfaces of the damper. An added advantage of such coolant air injection is that if uncombusted material remains in the combustion gases flowing through conduit 10, the addition of excess oxygen as may be provided by blower 72 may be sufficient to ignite them and thus produce more complete combustion in the furnace.

Since the box beam 48 and rod 60 remain in housing 26 they are not directly affected by the combustion gases.

Figure 5:
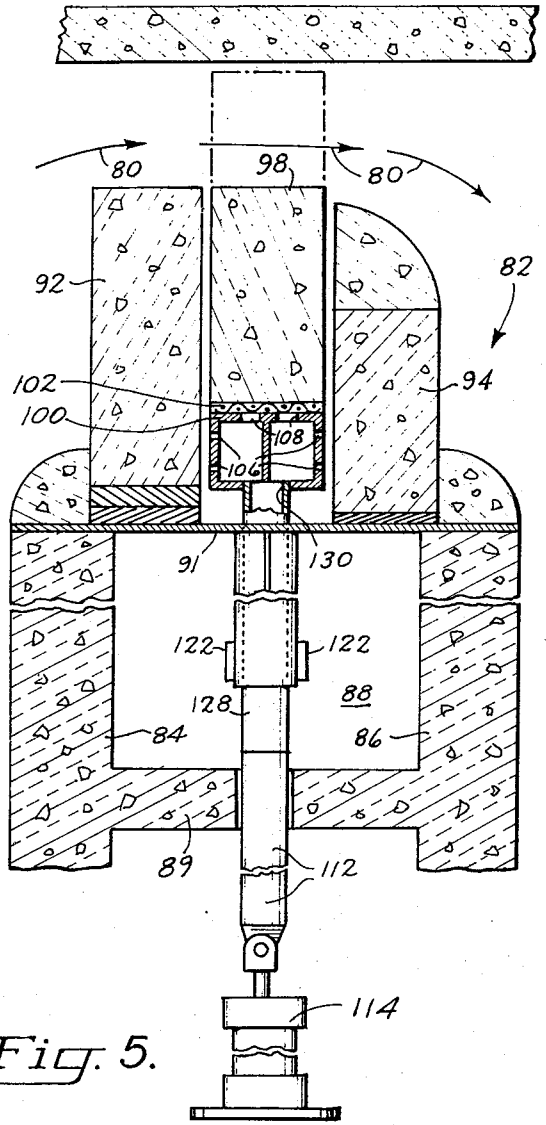
FIG. 5 is a view taken generally along the line 5—5 in FIG. 4.
Figure 4:
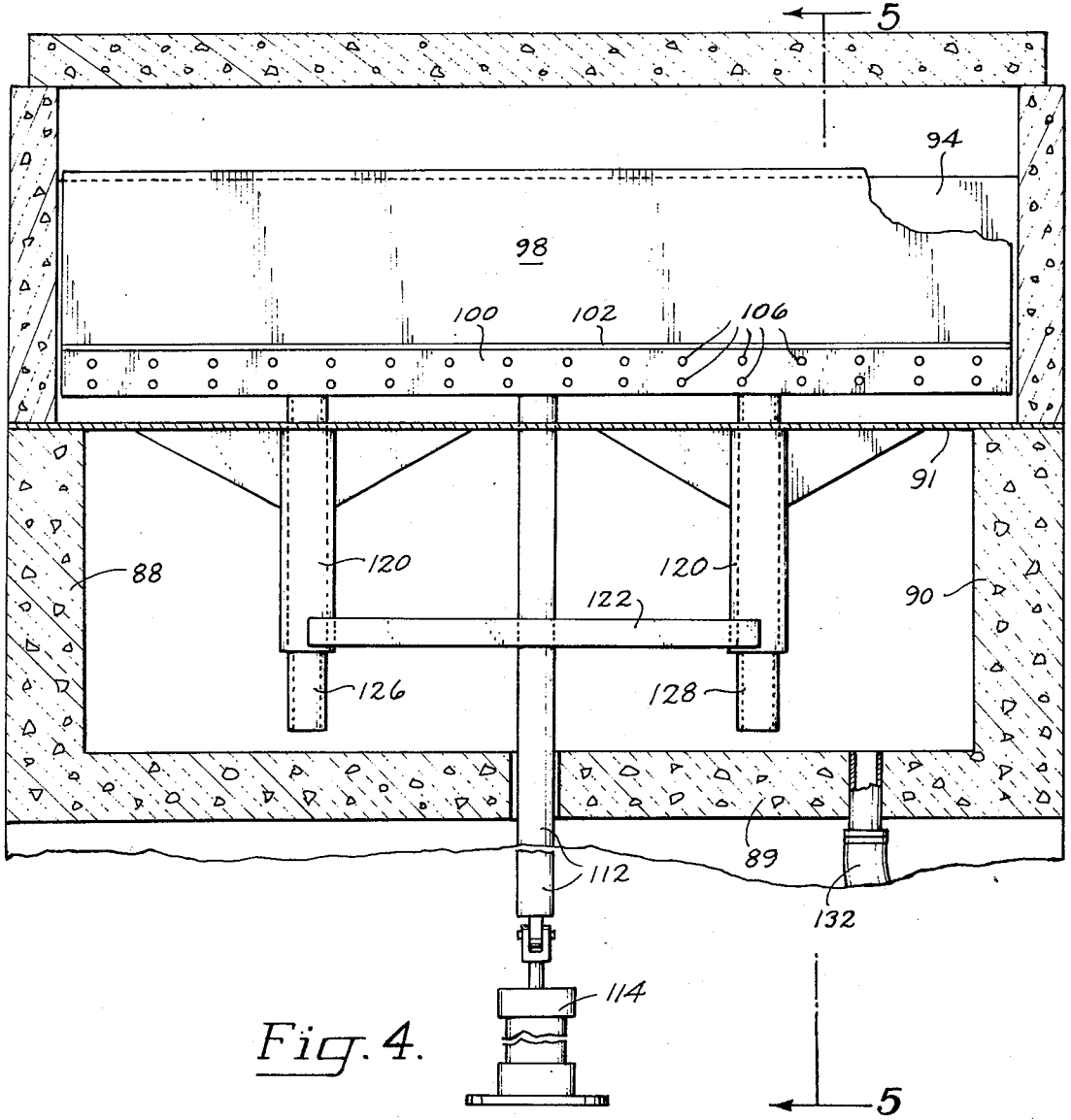
FIG. 4 is an elevation view of apparatus constructed according to a modified embodiment of the invention.

Referring to FIGS. 4 and 5, a modified embodiment of the invention is illustrated. In this embodiment, a conduit is provided through which combustion gases flow along a path as indicated by the arrows 80 in FIG. 5. A damper housing is indicated generally at 82 extending laterally of the path for combustion gases. The housing includes a pair of upright side walls 84, 86, end walls 88, 90, and a bottom wall 89. A flat support plate 91 rests atop and spans the space between side walls 84, 86. Side wall extensions 92, 94 are supported on and extend upwardly from side walls 84, 86 and plate 91 and span the distance between the opposed side walls of the furnace conduit through which combustion gases 80 flow.

The damper in this embodiment is a solid rectangular block of refractory material 98. Damper 98 is supported on an elongate hollow metal box beam 100 which extends along the full length of the underside of the damper. An expanded steel grate, or mesh, 102 is interposed between box beam 100 and damper 98 to support the damper a distance above the box beam. A plurality of apertures 106 are formed in opposed upright sides of box beam 100 and apertures 108 are formed in the top of the box beam.

An elongate upright operator rod 112 is secured to the underside of box beam 100, extends downwardly through an opening in bottom wall 89 of housing 82, and is operatively connected to the rod end of an upright ram 114. Extension of the ram shifts the damper vertically from its lowered position, as illustrated in FIG. 5 between side wall extensions 92, 94, and a raised position illustrated in dot-dashed outline closing off a major portion of the conduit. Retraction of the ram lowers the damper to the position illustrated in solid outline in FIGS. 4 and 5.

A pair of laterally spaced, elongate, hollow, vertically disposed guide sleeves 120 are secured at their upper ends to plate 91 and are held in selected spaced relationship adjacent their lower ends by bars 122 welded thereto.

A pair of guide tubes 126, 128 secured, as by welding, to the underside of box beam 100 extend slidably through sleeves 120. The lower ends of tubes 126, 128 open into housing 82, while their upper ends communicate through apertures, such as that indicated at 130 in FIG. 5, with the interior of box beam 100.

An elongate flexible conduit 132, an end portion only of which is shown, may be used to operatively connect a blower to the interior of housing 82.

In this embodiment, damper 98 is raised and lowered by extension and retraction of ram 114. Throughout operation box beam 100 is maintained in a shielded position between side wall extensions 92, 94.

Coolant air, or fluid, provided through conduit 132 to housing 82 may flow through tubes 126, 128 into the interior of box beam 100. From box beam 100 the coolant air may flow outwardly through apertures 106 at opposite sides of the beams, and apertures 108 in the top of the beam. The fluid flowing through apertures 108 is permitted to flow around the underside of the damper to opposite faces of the damper by grate 102 holding the damper in spaced relationship above box beam 100. This construction also is operable to produce a flow of coolant air across opposite faces of damper 98 and around the damper supports to shield them from detrimental effects of combustion gases flowing through the primary furnace conduits.

While preferred embodiments of the invention have been described herein, it should be apparent to those skilled in the art that variations and further modifications are possible without departing from the spirit of the invention.

It is claimed and desired to secure by Letters Patent:

1. Apparatus for controlling the flow of combustion gases along a path through a furnace conduit wherein said conduit has an opening defined in one of its sides, comprising a damper mounted for shifting between extended and retracted positions through said opening with a leading edge of said damper and portions of said damper adjacent said edge moving into said path when in an extended position and moving out of said path when in its retracted position, said damper being constructed of a refractory material, a metallic damper support connected to and supporting the edge of said damper opposite its said leading edge, said support having a coolant fluid flow passage defined therein and apertures providing communication between said passage and the exterior of said damper support through which a flow of coolant fluid may pass from said passage to the exterior of said support to cool said damper and support.

2. The apparatus of claim 1, wherein said damper has coolant fluid passages defined therein and extending therethrough communicating with said passage in the support.

3. The apparatus of claim 1, which further comprises coolant fluid supply means operatively connected to said damper support to provide a flow of coolant fluid under pressure to said damper support.

4. The apparatus of claim 3, wherein said damper support comprises an elongate hollow beam extending along and supporting a major portion of said opposite edge of the damper.

5. The apparatus of claim 3, which further comprises a damper housing extending laterally of said conduit for receiving said damper when shifted to its retracted position, said housing having side and end walls substantially enclosing said damper when in its retracted position, said support means further comprises an elongate tubular support rod having a passage extending therethrough communicating with said passage in the damper support, said rod extending slidably through an opening in said housing opposite said first-mentioned opening, and said coolant fluid supply means is operatively connected to said support rod for providing a flow of coolant fluid under pressure therethrough to said damper support.

6. The apparatus of claim 3, wherein said coolant fluid supply means comprises a blower operable to inject coolant air into said damper support for exhaust from said apertures.

7. The apparatus of claim 6, which further comprises means for directing a portion of said coolant fluid exhausted from said apertures across a face portion of said damper.

8. The apparatus of claim 5, wherein said side walls of said housing enclose opposite face surfaces of said damper when said damper is shifted outwardly from said conduit, and said side walls are operable to direct a flow of coolant fluid exhausted from said damper support across opposite faces of said damper.

9. The apparatus of claim 3, which further comprises a damper housing extending laterally of said conduit for receiving said damper when shifted toward its retracted position, said housing having side and end walls substantially enclosing said damper when shifted to its retracted position and shielding said damper support from direct effects of combustion gases in said conduit throughout operation of the damper.

10. The apparatus of claim 9, wherein said coolant fluid supply comprises a blower for injecting coolant air into said housing and damper support.

11. The apparatus of claim 1, wherein said damper support comprises an elongate hollow beam extending along and supporting a major portion of said opposite edge of the damper, said apertures extend through a side of said beam facing said damper, and which further comprises spacer means interposed between said beam and damper to permit coolant fluid to flow from said apertures and across face portions of said damper.

12. Apparatus for controlling the flow of combustion gases along a path through a furnace conduit wherein said conduit has an opening defined in a lower side thereof, comprising a damper mounted for shifting vertically through said opening between a raised position in which a leading edge of said damper and portions of the damper adjacent said leading edge extend into said conduit and a lowered position out of said path, said damper comprising a formed mass of refractory material, a metallic damper support extending along a major portion of the length of the underside of said damper to support the edge of said damper opposite said leading edge, said support having a fluid flow passage defined therein and apertures extending between said passage and the exterior of said beam through which a flow of fluid may pass from said passage to the exterior of said support, and a damper housing extending downwardly from said conduit for receiving said damper when shifted to its lowered position, said housing having side and end walls substantially enclosing said damper when lowered, and enclosing said damper support throughout operation to shield the same from direct effects of combustion gases in said conduit throughout operation of the damper.

* * * * *